US007556254B2

(12) United States Patent
Wada

(10) Patent No.: US 7,556,254 B2
(45) Date of Patent: Jul. 7, 2009

(54) IMAGE FORMING SYSTEM AND PAPER FEEDER THEREOF

(75) Inventor: Atsushi Wada, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 281 days.

(21) Appl. No.: 11/560,534

(22) Filed: Nov. 16, 2006

(65) Prior Publication Data

US 2007/0120313 A1 May 31, 2007

(30) Foreign Application Priority Data

Nov. 25, 2005 (JP) ..... 2005-340920

(51) Int. Cl.
*B65H 3/44* (2006.01)

(52) U.S. Cl. ..... 271/9.02; 271/9.01; 271/9.11; 271/9.13; 412/9; 399/391

(58) Field of Classification Search ..... 271/9.01, 271/9.02, 9.11, 9.13
See application file for complete search history.

(56) References Cited

U.S. PATENT DOCUMENTS 5,963,755 A 10/1999 Ueda et al. ..... 399/23
6,032,942 A * 3/2000 Cho ..... 271/9.11
7,380,780 B2 * 6/2008 Sasaki et al. ..... 271/9.02

FOREIGN PATENT DOCUMENTS

JP 08-286567 11/1996

* cited by examiner

*Primary Examiner*—Kaitlin S Joerger
(74) *Attorney, Agent, or Firm*—Fitzpatrick, Cella, Harper & Scinto

(57) ABSTRACT

A first signal line is provided for transmitting to each of a plurality of paper feeders an output signal from a printing paper sensor provided in the uppermost paper feeder among the plurality thereof. In response to an output signal that has been transmitted via the first signal line, a halting unit causes a halt to processing that is for transporting printing paper in each of the paper feeders.

15 Claims, 12 Drawing Sheets

IMAGE FORMING SYSTEM AND PAPER FEEDER THEREOF

BACKGROUND OF THE INVENTION

1. Field of the Invention

The present invention relates to control of paper feed in an image forming system.

2. Description of the Related Art

An image forming apparatus to which multiple optional units can be connected has been proposed heretofore (see the specification of Japanese Patent Application Laid-Open No. 08-286567). This image forming apparatus controls each optional unit through an overall controller.

In order to increase the number of sheets of printing paper that can be fed, it is desired that a plurality of optional paper feeders be connected to the image forming apparatus in multiple stages. Such an image forming apparatus often employs serial communication in order to transmit a motor-stop command or a drive-start command to each paper feeder.

In a case where the above commands are transmitted to each paper feeder by serial communication, however, the traveling time of the command to each paper feeder deviates depending upon the distance from the image forming apparatus (see FIGS. 8A and 8B).

For example, traveling times of commands to each of the paper feeders connected to the image forming apparatus differ from one another. Consequently, the time between preceding and following sheets of printing paper varies depending upon the difference in traveling times. With such an arrangement, even if it is attempted to raise throughput by raising the speed of paper feed, a limitation is imposed because it is necessary to take into account the variance in time between the paper sheets. Further, owing to the difference in command traveling times, paper jamming may occur if the time between paper sheets becomes smaller than the appropriate value. For example, if a plurality of paper feeders is used for feeding paper sheets, the time between the preceding sheet and the following sheet varies at the timing of switching one paper feeder to another paper feeder. If the sheet-to-sheet space is prolonged due to the deviation between the traveling times of the command to each paper feeder, the throughput may go down. On the other hands, if the sheet-to-sheet space is shortened due to the deviation, the paper jam may be occurred. Further, the timing of stopping the paper sheet deviates in case that the paper sheet, which strides over the plurality of paper feeders, is instructed to stop. More particularly, the jam is occurred, since the paper sheet is pressed into the paper feeder located in downstream or is pulled by two paper feeders. In addition, image adjusting processing (e.g., processing for adjusting toner density and processing for adjusting paper registration) executed in the time between sheets can no longer be performed sufficiently. This is undesirable as it results in a decline in image quality.

SUMMARY OF THE INVENTION

A feature of the present invention is an image forming system and paper feeder in which, in an arrangement having multiple connected paper feeders, a variance in time between sheets due to a difference in communication times to the paper feeders can be reduced to raise speed.

Another feature of the present invention is an image forming system and paper feeder in which it is possible to reduce jamming caused by a difference in communication times to multiple paper feeders, by way of example.

The present invention is well suited for application to an image forming system that includes an image forming apparatus for forming an image and paper feeders for feeding printing paper. For example, a communication line by which the image forming apparatus instructs the plurality of paper feeders to perform operation is provided. Also provided is a drive signal line for transmitting an operation instruction signal for the purpose of operating the plurality of feeders. When the operation instruction signal is output via the drive signal line in response to a paper-feed start instruction transmitted from the image forming apparatus via the communication line, the plurality of paper feeders start being driven and execute paper feed.

In accordance with the present invention, an output signal from a sensor of the paper feeder situated at the highest stage is shared by each of the paper feeders, thereby making it possible to reduce a variance in sheet spacing and the occurrence of jamming, which are due to a difference in communication times to each of the paper feeders.

Further features of the present invention will become apparent from the following description of exemplary embodiments with reference to the attached drawings.

DESCRIPTION OF THE EMBODIMENTS

Figure 1:
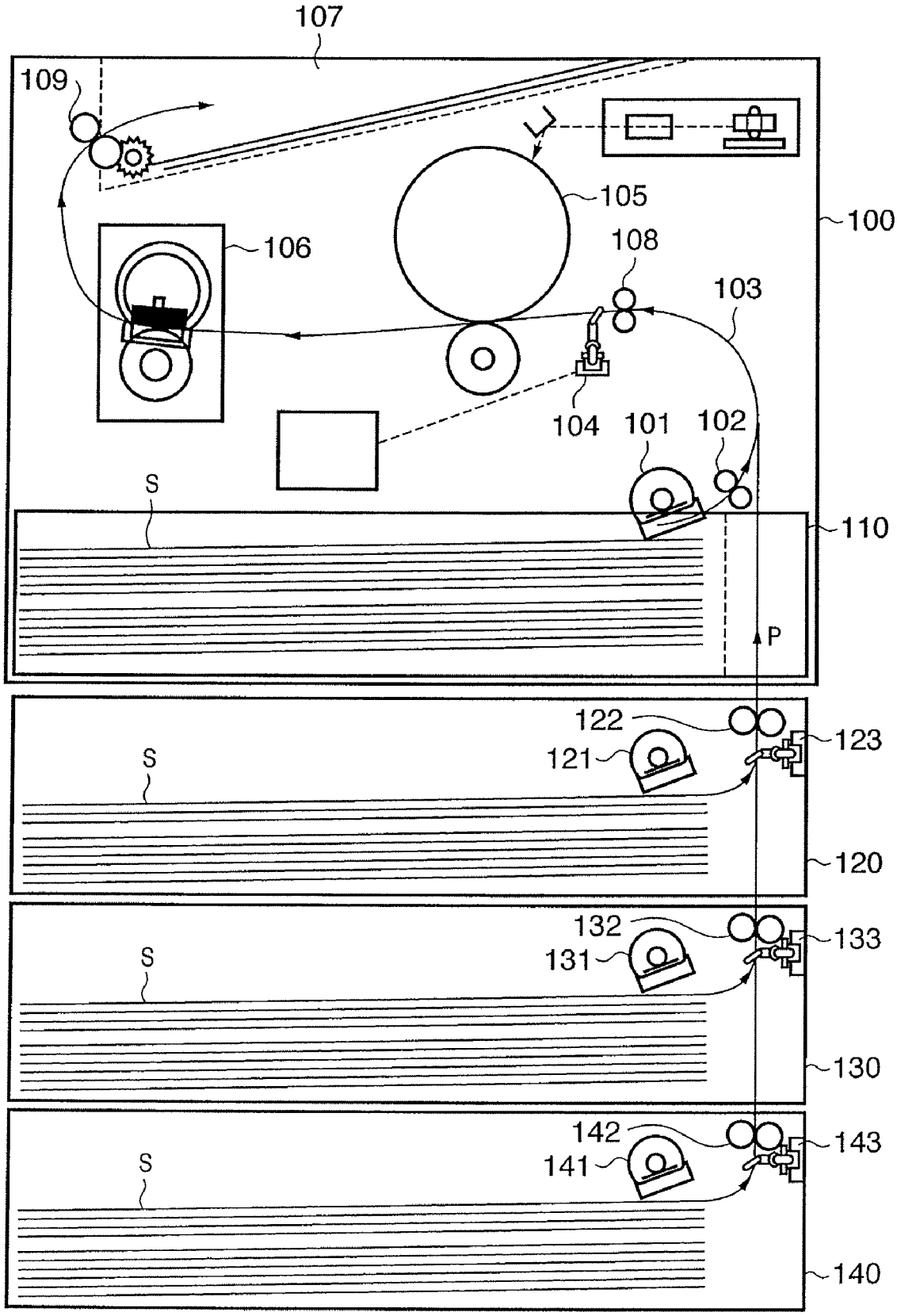
FIG. 1 is a schematic sectional view of an image forming system according to an embodiment of the present invention.

FIG. 1 is a schematic sectional view of an image forming system according to an embodiment of the present invention. The image forming system includes an image forming apparatus 100 and optional paper feeders 120, 130 and 140. As illustrated in FIG. 1, the optional paper feeders 120, 130 and 140 are connected in multiple stages below the image forming apparatus 100. The first paper feeder 120 situated at the uppermost stage is directly connected below the image forming apparatus 100, the second paper feeder 130 is connected below the first paper feeder 120, and the third paper feeder 140 is connected below the second paper feeder 130. A fourth paper feeder may be connected below the third paper feeder 140. It should be noted that the image forming apparatus may also be referred to as a printing apparatus, printer, copier, multifunction peripheral and facsimile machine, etc.

The image forming apparatus 100 has an internally provided paper cassette 110. Printing paper S stacked in the paper cassette 110 is fed to transport rollers 102 by a pick-up roller 101. The printing paper S is transported in a transport path 103 by the transport rollers 102. The leading and trailing edges of the printing paper S are sensed by a sheet sensor 104 provided in the transport path 103. Registration rollers 108 feed the printing paper S into an image forming unit 105 while the position of the leading edge of the printing paper S is adjusted in accordance with the results of detection by the sheet sensor 104. The printing paper may also be referred to as a printing material, printing medium, paper, a sheet, a transfer material or transfer paper.

The image forming unit 105 forms an image on the surface of the printing paper S. A fixing unit 106 fixes the image that has been formed on the surface of the printing paper S. The printing paper S is subsequently discharged into a drop tray 107 by discharge rollers 109.

The first paper feeder 120 is provided with a pick-up roller 121, transport rollers 122 and a sheet sensor 123. The sheet sensor 123 is one example of a printing paper sensor and detects the leading edge of the printing paper S fed by the pick-up roller 121. The sheet sensor 123 also detects the leading edge of the printing paper S that has been fed from any of the paper feeders connected below the paper feeder 120. The transport rollers 122 transport these sheets of printing paper S farther upward (e.g., to the image forming apparatus 100).

The second paper feeder 130 is provided with a pick-up roller 131, transport rollers 132 and a sheet sensor 133. The sheet sensor 133 is one example of a printing paper sensor and detects the leading edge of the printing paper S fed by the pick-up roller 131. The sheet sensor 133 also detects the leading edge of the printing paper S that has been fed from any of the paper feeders connected below the paper feeder 130. The transport rollers 132 transport these sheets of printing paper S farther upward (e.g., to the first paper feeder 120).

The third paper feeder 140 is provided with a pick-up roller 141, transport rollers 142 and a sheet sensor 143. The sheet sensor 143 is one example of a printing paper sensor and detects the leading edge of the printing paper S fed by the pick-up roller 141. The sheet sensor 143 also detects the leading edge of the printing paper S that has been fed from this paper feeder. The transport rollers 142 transport these sheets of printing paper S farther upward (e.g., to the second paper feeder 130).

Figure 2:
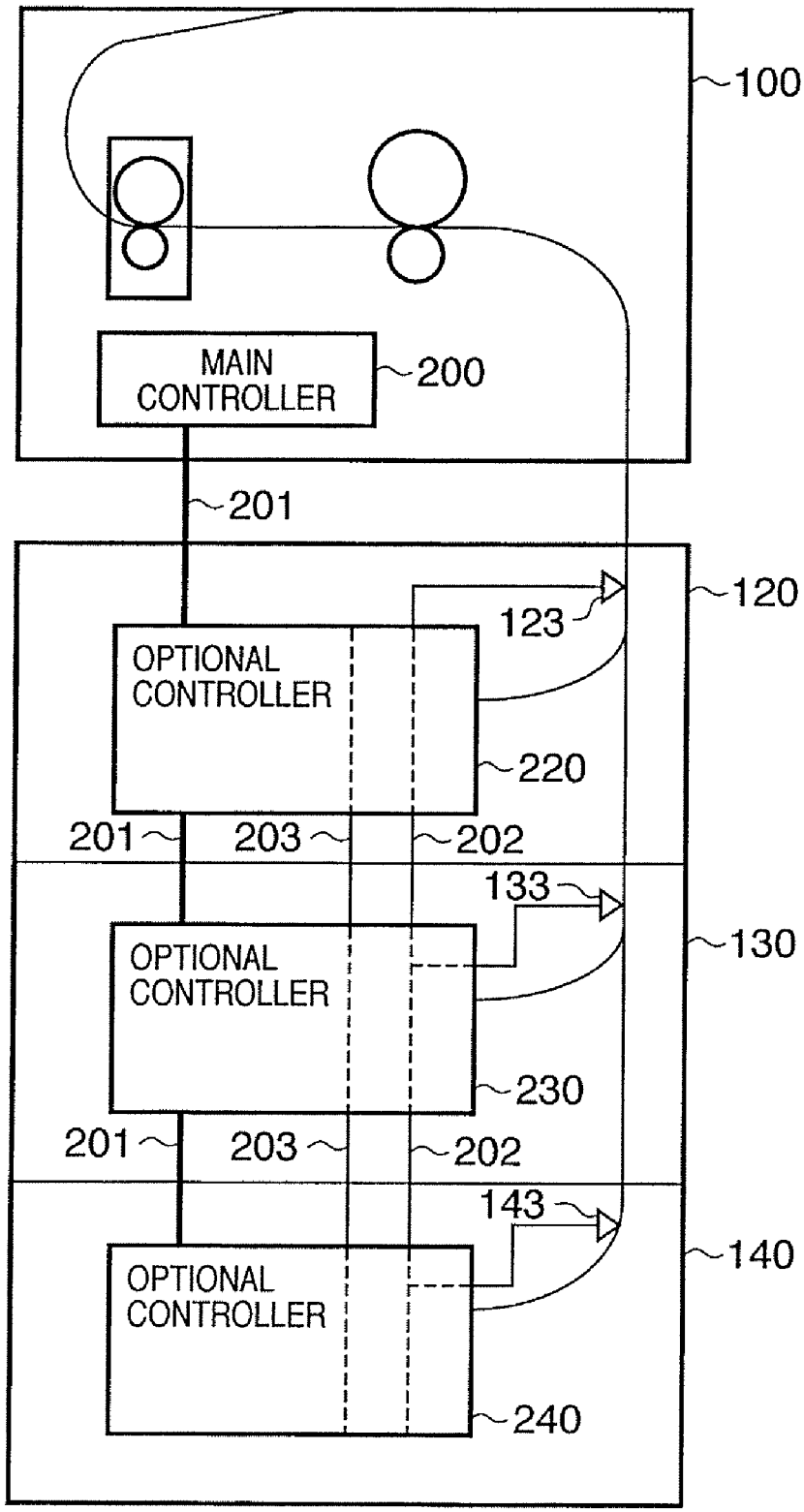
FIG. 2 is a diagram illustrating an example of a connection between controllers according to the embodiment.

FIG. 2 is a diagram illustrating an example of a connection between controllers in this embodiment. A main controller 200 includes an image processing unit for executing image data expansion, etc., and an engine controller for controlling an image forming unit such as the image forming unit 105. An optional controller 220 is a control unit for controlling the motor of the first paper feeder 120, an optional controller 230 is a control unit for controlling the motor of the second paper feeder 130, and an optional controller 240 is a control unit for controlling the motor of the third paper feeder 140.

Instructions such as a paper feeding (pick-up) start instruction from the main controller 200 are transmitted to the paper feeder 120, 130 or 140. In the present invention, the paper feeders 120, 130 and 140 are provided with two signal lines 202 and 203 that are separate from a serial communication line 201. The first signal line 202 is a hardware signal line for transmitting the output signal (detection signal) of the sheet sensor 123, which is provided in the paper feeder (e.g., the first paper feeder 120) situated at the uppermost stage, to the paper feeders 120 to 140. The second signal line 203 is a hardware signal line for transmitting a signal (e.g., an operation instruction signal), which stops or starts transport processing in each of the paper feeders concurrently, to the paper feeders 120 to 140. Accordingly, the first signal line 202 can also be referred to as a sensor signal line, and the second signal line 203 can be referred to as a motor drive signal line.

Figure 3:
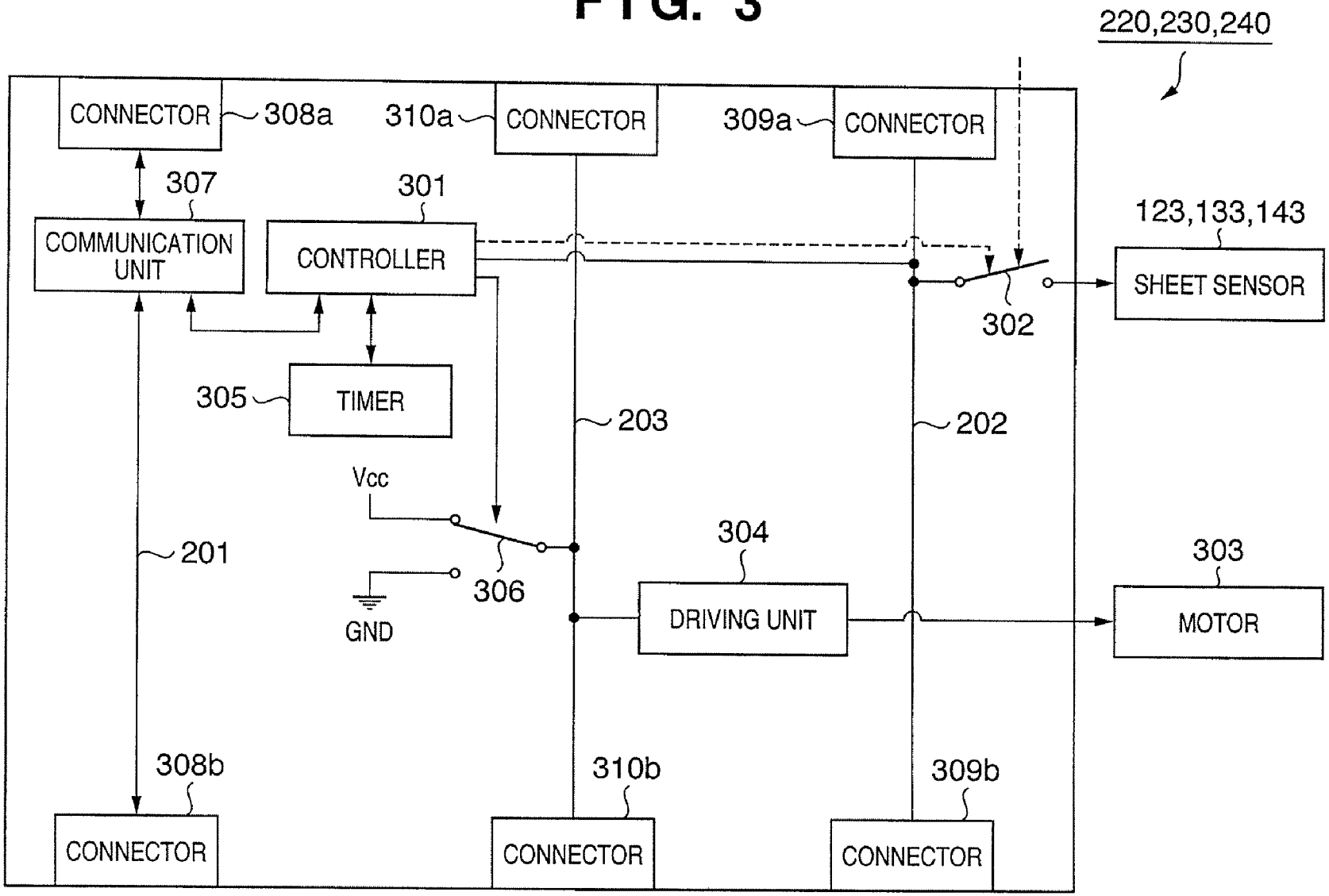
FIG. 3 is a block diagram illustrating an exemplary optional controller according to the embodiment.

FIG. 3 is a block diagram illustrating an exemplary optional controller according to this embodiment. According to this embodiment, the structures of the optional controllers 220, 230 and 240 will be described together for the sake of explanation. However, the structure of the optional controllers 220, 230 and 240 need not all be exactly the same so long as these optional controllers can achieve the functions described below.

A controller 301 is a control circuit for performing overall control of each of the components within the paper feeder. The controller 301 can be implemented utilizing at least one among a processing circuit, ASIC and CPU. A switch 302 is for changing over whether the output signal of the sheet sensor is connected to the first signal line 202. The switch 302 of the uppermost paper feeder 120 connects the output signal of the sheet sensor 123 to the first signal line 202. The switches 302 of the paper feeders 130 and 140 that are not the uppermost paper feeder disconnect the output signals of the sheet sensors 133 and 143 from the first signal line 202. As a result, only the output signal from the sheet sensor 123 provided in the uppermost first paper feeder 120 is transmitted to the paper feeders 120, 130 and 140.

It should be noted that the first signal line 202 is electrically connected between the plurality of paper feeders 120 to 140 connected in multiple stages. A connector 309*a* is electrically connected to a connector 309*b* of the paper feeder connected above it. Conversely, the connector 309*b* is electrically connected to the connector 309*a* of the paper feeder connected below it. In a case where the image forming apparatus 100 is connected above the paper feeder, the connector 309*a* is left open. In a case where nothing is connected below a paper feeder, the connector 309*b* is left open.

Each controller 301 of the paper feeders 120, 130 and 140 monitors signals transmitted over the first signal line 202. For example, the controller 301 determines whether the signal level of the first signal line 202 is at a prescribed level that signifies TRUE. The signal level of the first signal line 202 is at the prescribed level when the sheet sensor 123 has sensed the printing paper S.

When the signal level is at the prescribed level, the controller 301 switches the signal level of the second signal line 203 from a start level (TRUE) for starting transport processing to a stop level (FALSE) for stopping transport processing. For example, if the signal level of the first signal line 202 is TRUE, the controller 301 causes a prescribed period of time to be measured by a timer 305. If the prescribed period of time is measured, the controller 301 changes over the switch 306 so as to change the connection of the second signal line 203 from Vcc to ground (GND). Here Vcc is a power line for supplying the voltage of the start level (TRUE) representing concurrent drive of the motors 303. Further, GND is a ground line for achieving the stop level (FALSE) representing concurrent stopping of the motors 303.

A driving unit 304 drives the motor 303 for driving the transport rollers 122, etc., in accordance with the signal level of the second signal line 203. For example, driving unit 304 stops operation of the motor 303 when the signal level of the second signal line 203 becomes FALSE. If operation of the motor 303 is stopped, the transport rollers 122, etc., stop rotating and therefore transport of the printing paper S also stops. The prescribed period of time is decided empirically in such a manner that the leading edge of the printing paper S stops at a pre-feed position P (see FIG. 1).

It should be noted that the second signal line 203 is electrically connected between the plurality of paper feeders 120 to 140 connected in multiple stages. A connector 310*a* is electrically connected to a connector 310*b* of the paper feeder connected above it. Conversely, the connector 310*b* is electrically connected to the connector 310*a* of the paper feeder connected below it. In a case where the image forming apparatus 100 is connected above the paper feeder, the connector

310*a* is left open. In a case where nothing is connected below a paper feeder, the connector 310*b* is left open.

The controller 301 receives various commands from the main controller 200 through the serial communication line 201 and transmits various information to the main controller 200. A connector 308*a* is a terminal for electrically connecting the serial communication line 201 to the image forming apparatus 100 above or to another paper feeder. A connector 308*b* is a terminal for connecting the serial communication line 201 to the connector 308*a* of the paper feeder below.

For example, if the controller 301 receives a command for resuming transport from the main controller 200 through the serial communication line 201, the controller changes over the switch 306. As a result, the signal level of the second signal line 203 changes from the stop level (FALSE) to the start level (TRUE). If the signal level of the second signal line 203 changes from FALSE to TRUE, the driving unit 304 start operation of the motor 303.

It should be noted that a change in the signal on the second signal line 203 is transmitted immediately to each paper feeder connected in multiple stages through the connector 310*a* or 310*b*. Accordingly, the motors 303 in respective ones of the paper feeders 120, 130 and 140 rotate concurrently. If drive of the motors 303 starts, the transport rollers 122, 132 and 142 resume rotation concurrently and therefore transport of the printing paper S also is resumed.

The controller 301 that is capable of changing over the signal level of the second signal line 203 preferably is the controller installed in the paper feeder instructed by the main controller 200 to feed paper. That is, the switches 306 in respective ones of the optional controllers 220, 230 and 240 preferably operate exclusively. The reason for this is that the second signal line 203 is a signal line that is electrically coupled among the plurality of paper feeders.

The arrangement of the switch 306 illustrated in FIG. 3 is such that the signal level of the second signal line 203 becomes TRUE even if just one of these switches included in the optional controllers 220, 230 and 240 is connected to Vcc. Conversely, the signal level of the second signal line 203 will not become FALSE unless all of the switches 306 are connected to GND. Preferably, therefore, the only switch 306 to operate will be that contained in the paper feeder instructed by the main controller 200 to feed paper.

Of course, it will suffice in the present invention if rotation of the motors 303 mounted in each of the paper feeders 120 to 140 can be stopped or started concurrently. Accordingly, the mechanism for changing over the signal level regarding the second signal line 203 may be implemented in another way. It should be noted that the term "concurrently" is not intended to mean that the stop timings or start timings of the paper feeders coincide perfectly and stringently. That is, a difference in timing to such an extent that will not result in the occurrence of jamming or an extreme decline in throughput mentioned above is allowable.

As mentioned above, only the output signal from the sheet sensor 123 provided in the uppermost paper feeder 120 is transmitted to the paper feeders 120, 130 and 140. In order to achieve this, a mechanism for changing, over the switch 302 is required. That is, it is required that each paper feeder have a function for sensing or discriminating whether it itself is the uppermost paper feeder.

Figure 4A:
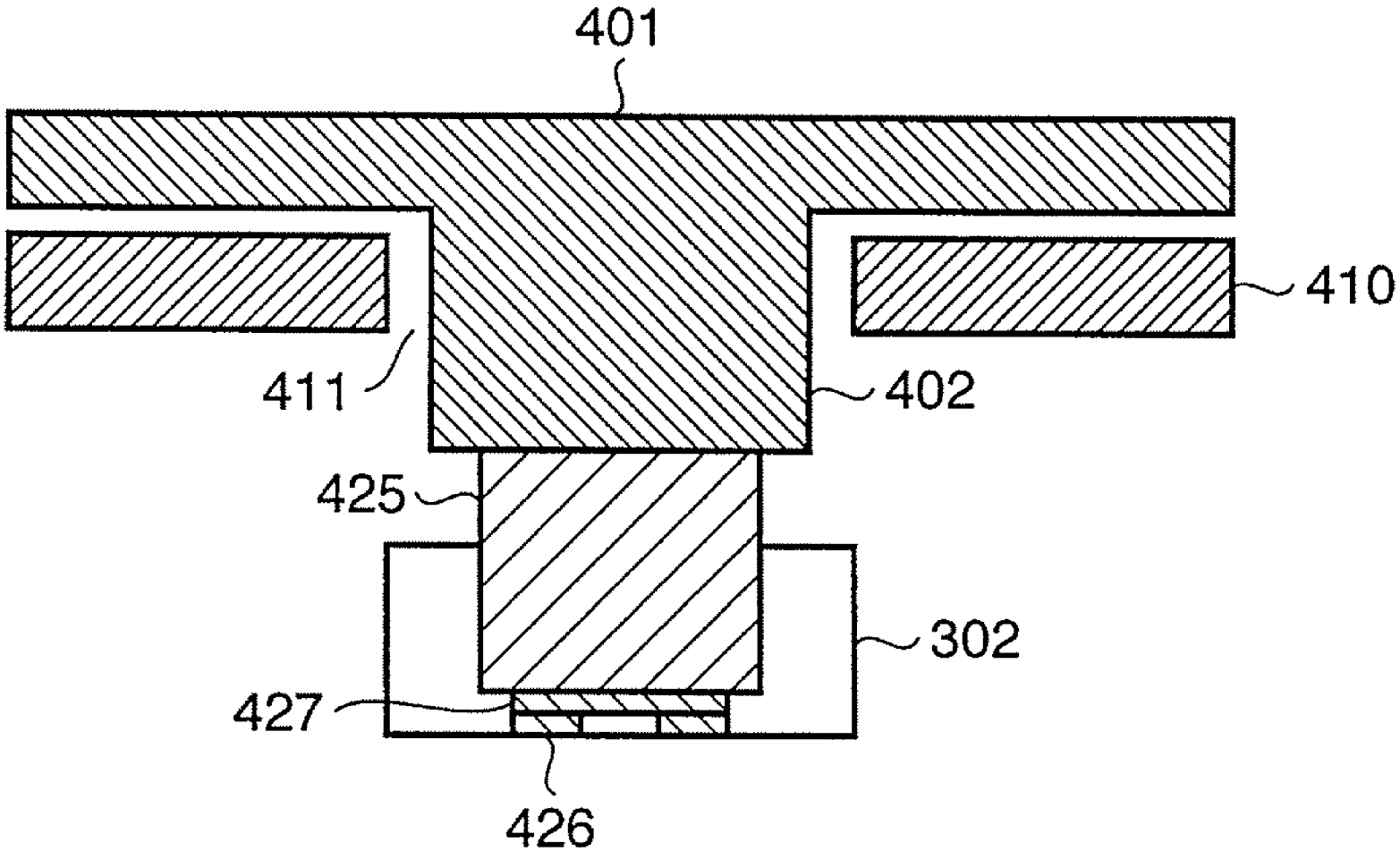
FIGS. 4A, 4B, 5A, 5B, 6A and 6B are schematic sectional views of exemplary mechanisms for sensing an uppermost paper feeder according to embodiments.
Figure 4B:
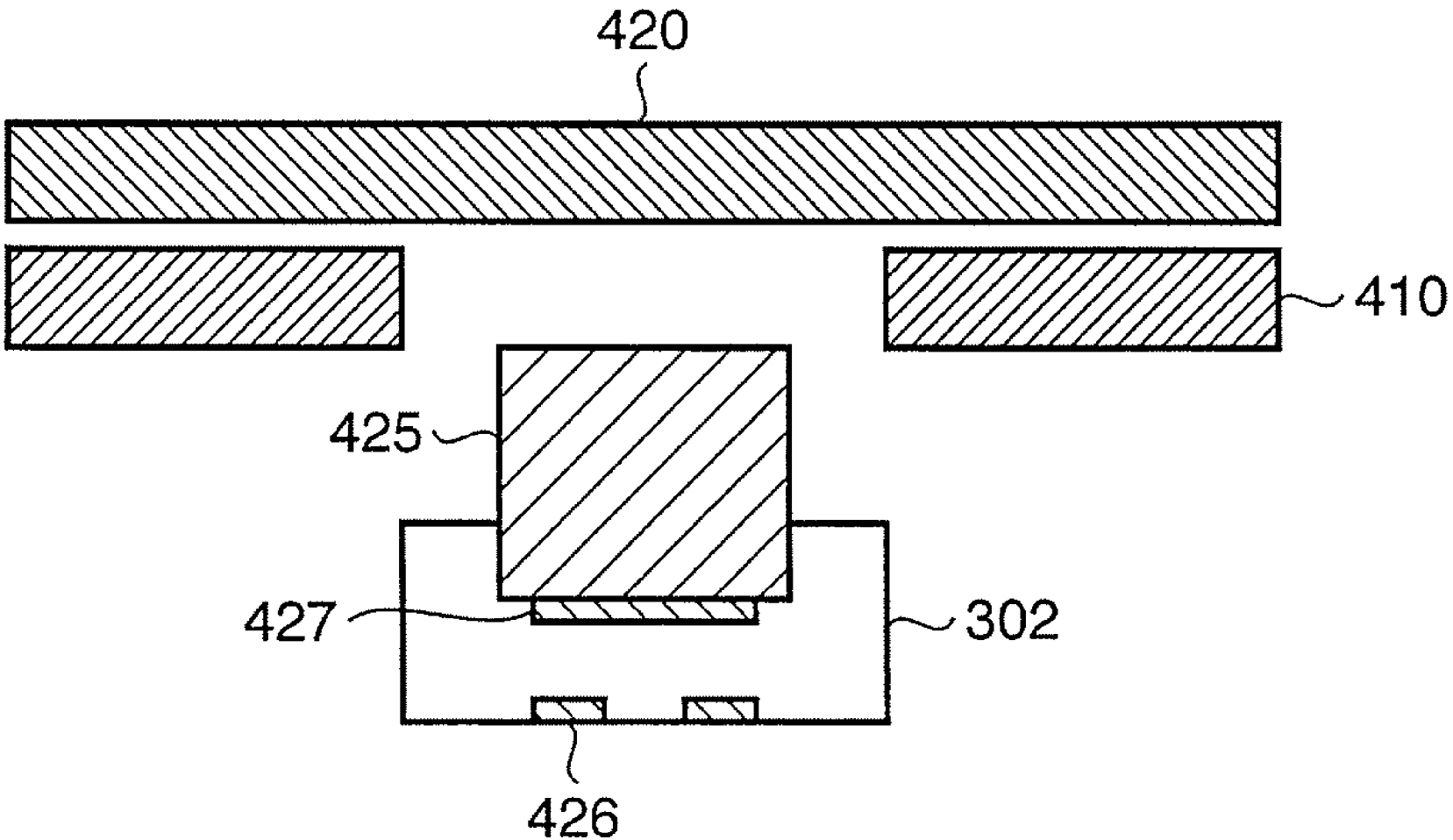

FIGS. 4A and 4B are schematic sectional views of an exemplary mechanism for sensing an uppermost paper feeder according to an embodiment. The image forming apparatus 100 has a bottom member 401. In this example, a member (e.g., a boss) 402 is provided on a bonded surface of the bottom member 401 that opposes the uppermost paper feeder. The bonded surface of the bottom member 401 that opposes the uppermost paper feeder is further provided with a hole 411 for receiving the boss 402. The paper feeder has a top member 410. That is, the hole 411 is provided in part of the top member 410.

The switch 306 is placed below the hole 411. As illustrated in FIG. 4B, the switch 302 has a push portion 425 that is normally upwardly biased by an elastic member such as a spring, as a result of which a fixed contact 426 and a movable contact 427 separate. This state is the OFF state. On the other hand, if the push portion 425 is pushed down by the boss 402, then the fixed contact 426 and movable contact 427 are short-circuited. This is the ON state. Thus, the switch 302 also functions as a part that senses the presence of the boss 402. It should be noted that such a boss is not provided on a lower portion 420 of each paper feeder. Accordingly, if another paper feeder has been connected above, the switch 302 stays in the OFF state (see FIG. 4B). Thus, only the switch 302 of the uppermost paper feeder is ON.

Figure 5A:
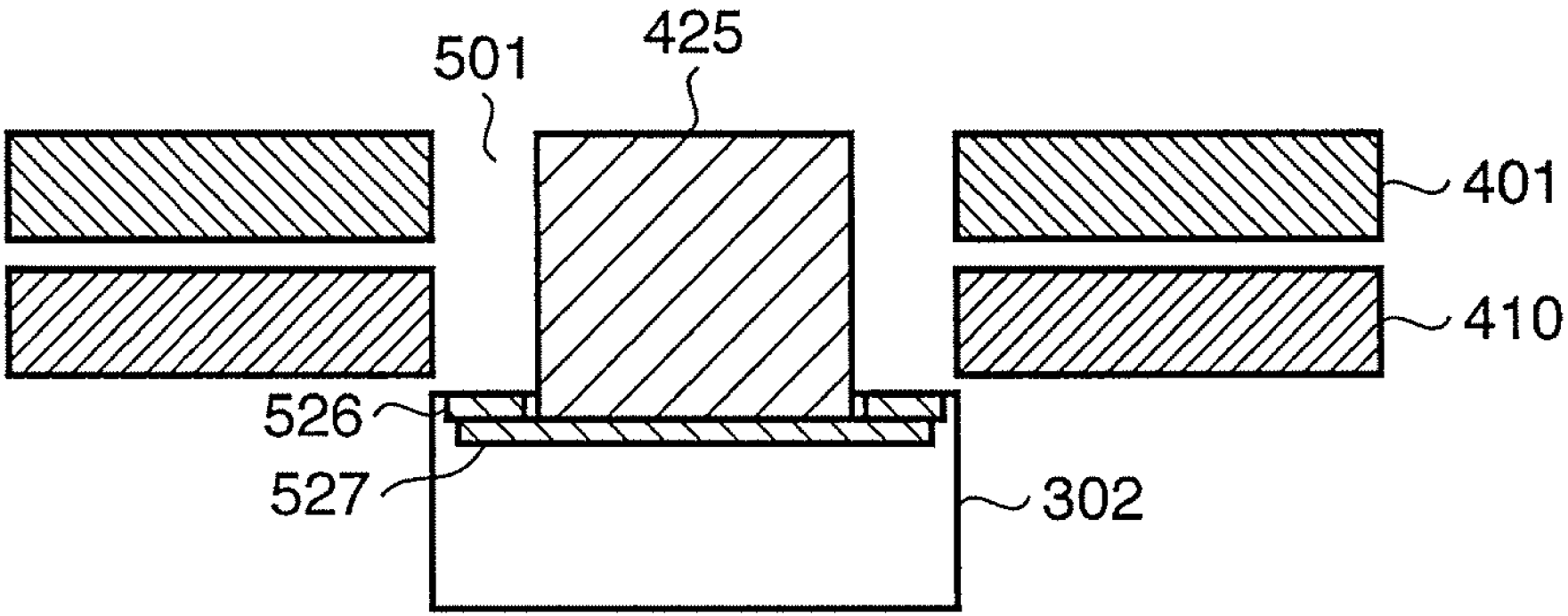
Figure 5B:
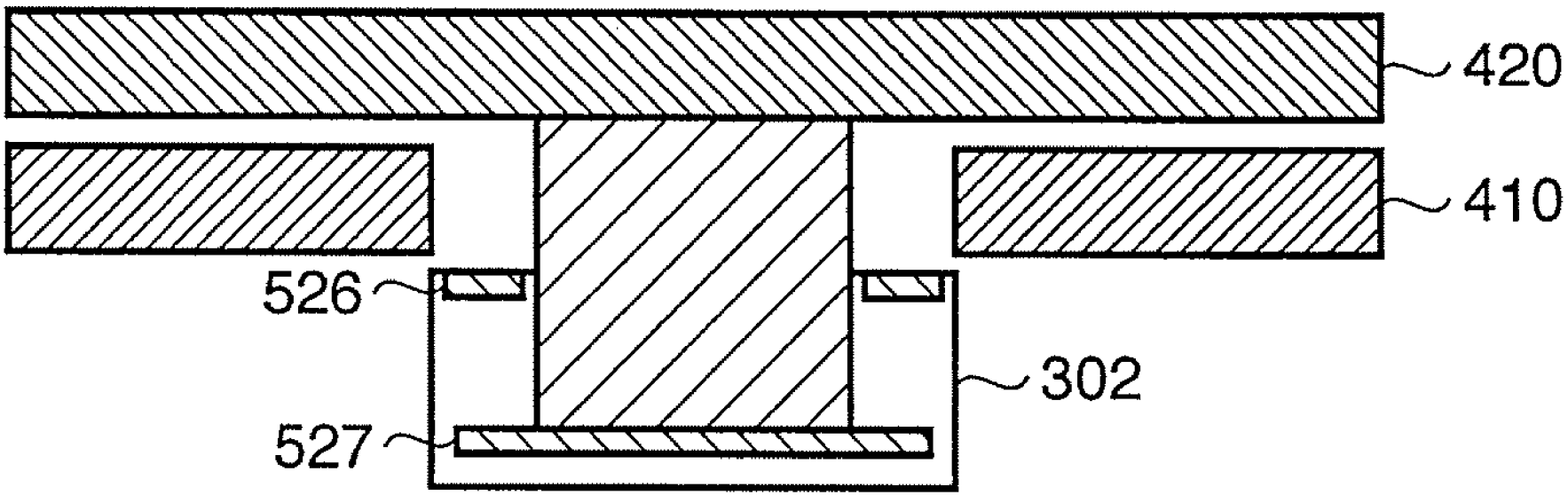

FIGS. 5A and 5B are schematic sectional views of an exemplary mechanism for sensing an uppermost paper feeder according to an embodiment. As illustrated in FIGS. 5A and 5B, the relationship between the boss and hole may be reversed. That is, the bonded surface of the image forming apparatus 100 that opposes the uppermost paper feeder is provided with a hole 501 as a member. Further, the switch 302 is provided with the push portion 425 serving as a boss that can be pushed down. In this case, the switch 302 is such that if the push portion 425 is projected, a fixed contact 526 and a movable contact 527 are short-circuited (see FIG. 5A) That is, the switch 302 is turned ON.

If the push portion 425 is pushed down, on the other hand, the fixed contact 526 and a movable contact 527 separate (see FIG. 5B). Accordingly, the switch turns OFF. It goes without saying that the lower portion 420 of the paper feeder is not provided with the hole 501. Alternatively, the boss 402 illustrated in FIG. 4A may be provided on the lower portion 420 of the paper feeder. Thus, it is so arranged that the push portion 425 provided on the switch 302 of an underlying paper feeder is pushed down by the lower portion 420 of the overlying paper feeder.

Figure 6A:
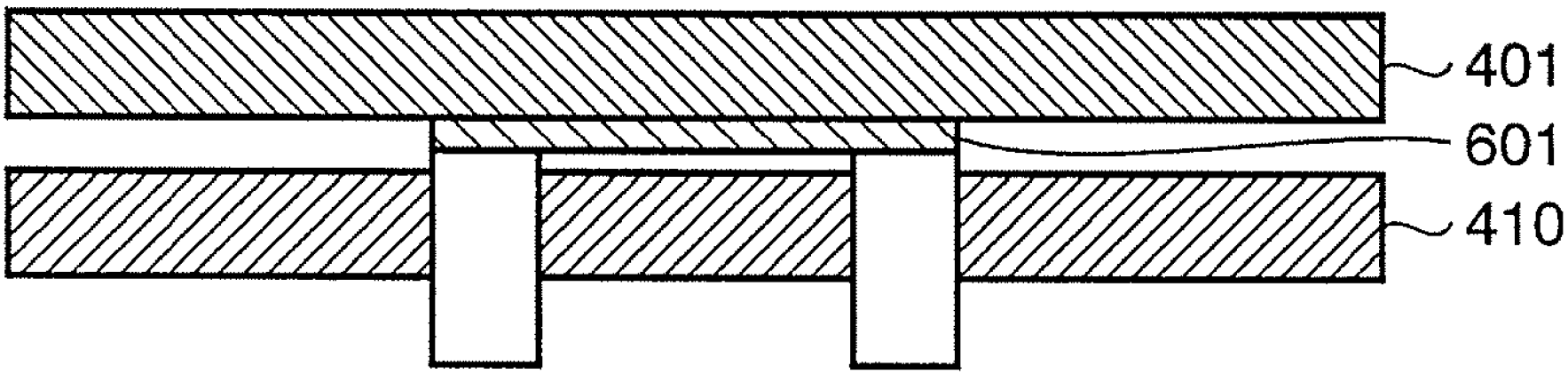
Figure 6B:
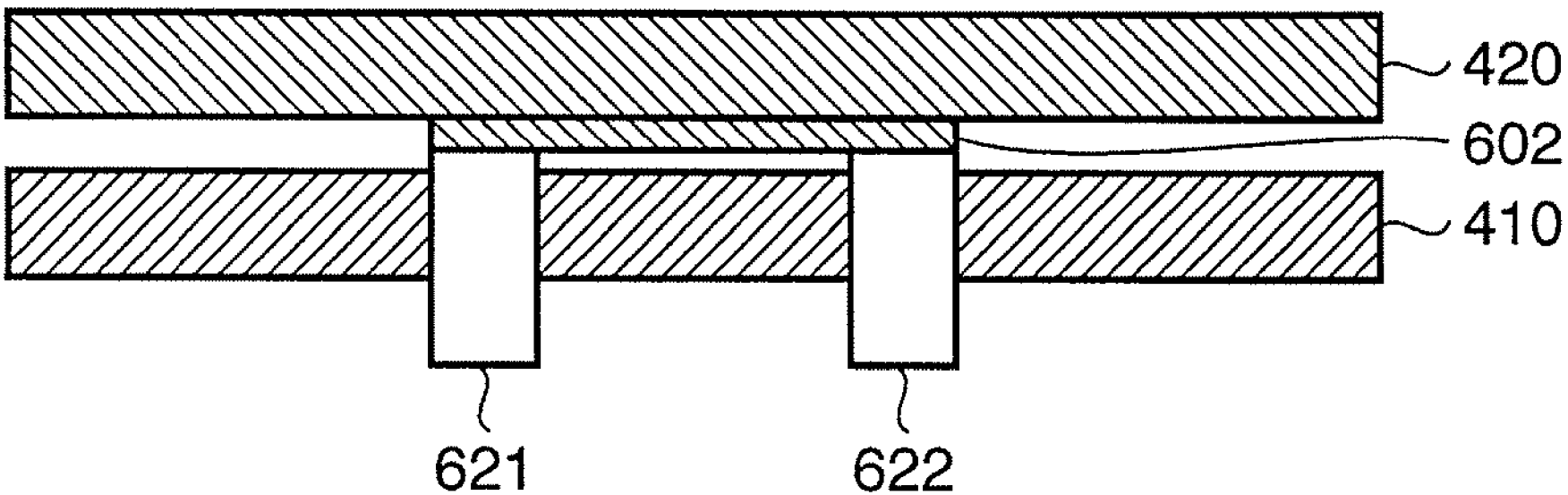

FIGS. 6A and 6B are schematic sectional views of an exemplary mechanism for sensing an uppermost paper feeder according to an embodiment. In this example, the member of the image forming apparatus 100 is made a plate 601 having electrical conductivity. Sensing members of the paper feeder may be made two terminals 621, 622 that are short-circuited by the plate 601. The lower portion 420 of the paper feeder is provided with an insulating member 602 for opening the terminals. In a case where the lower portion 420 itself is formed from an insulting material, the additional insulating member 602 would be unnecessary.

Further, based upon information that has been received from the image forming apparatus 100, the controller 301 of each paper feeder may discriminate whether this paper feeder per se is the uppermost paper feeder. By communicating with the optional controllers 220, 230 and 240 of respective ones of the paper feeders, the main controller 200 identifies which of the paper feeders is the uppermost paper feeder. Using the serial communication line 201, the main controller 200 sends each of the optional controllers 220, 230 and 240 information indicating whether the paper feeder is the uppermost paper feeder. On the basis of this information, the controller 301 of each paper feeder discriminates whether this paper feeder per se is the uppermost paper feeder.

Figure 7:
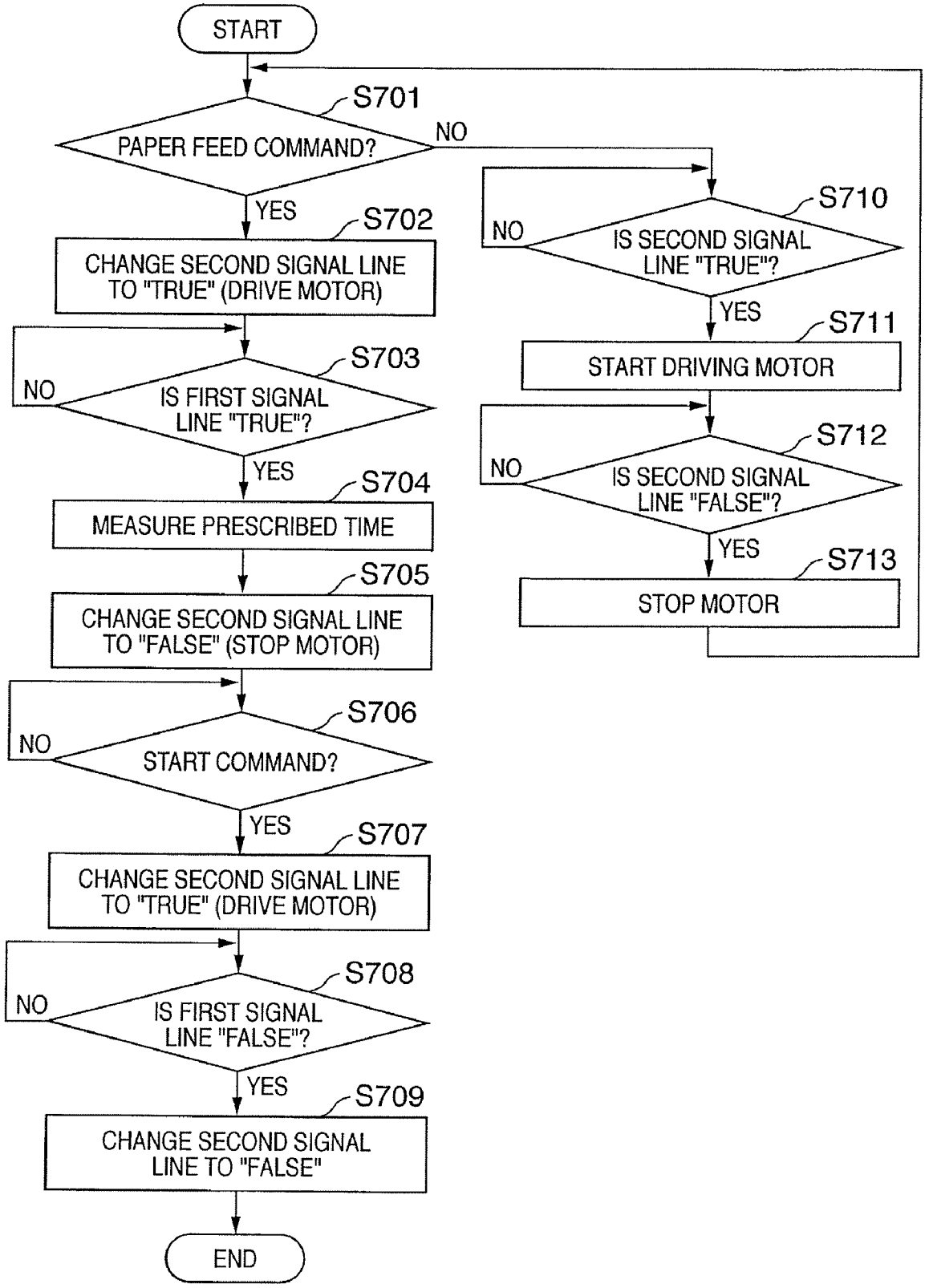
FIG. 7 is a flowchart illustrating an exemplary method of controlling a paper feeder according to the embodiment.

FIG. 7 is a flowchart illustrating an exemplary method of controlling a paper feeder according to the embodiment. At step S701, the controller 301 determines whether a paper feed command has been received via the serial communication line 201. If the paper feed command has been received, then the controller 301 has acquired the right to change the second signal line 203. If the paper feed command has not been received, on the other hand, then the controller 301 does not possess the right to change the second signal line 203 and control therefore proceeds to step S710.

At step S702, the controller 301 changes over the second signal line 203 to TRUE. That is, the controller 301 changes the switch 302 over to the side of Vcc. Further, the controller 301 causes the pick-up roller 121 to rotate so that the printing paper S is fed to the transport rollers 122. Further, since the second signal line 203 has been changed to TRUE (S710), the driving units 304 of the paper feeders 120, 130 and 140 start rotating the motors 303 (S711). In response, the transport rollers 111, 132 and 142 are driven concurrently.

At step S703, the controller 301 determines whether the first signal line 202 has become TRUE. In case of TRUE, control proceeds to step S704. Here the controller 301 starts the timer 305 to measure the prescribed period of time. The prescribed period of time is a period of time required for the leading edge of printing paper S to reach the pre-feed position P after it has been sensed by the sheet sensor 123. If the prescribed period of time is measured by the timer 305, control proceeds to step S705.

At step S705, the controller 301 changes over the second signal line 203 to FALSE. Since the second signal line 203 has been changed to FALSE (S712), the driving units 304 of each of the paper feeders 120, 130 and 140 stop the rotation of the motors 303 (S713). As a result, the transport rollers 122, 132 and 142 stop concurrently.

At step S706, the controller 301 determines whether a command for starting drive again has been received. If the command has been received, then control proceeds to step S707. Here the controller 301 changes over the second signal line 203 to TRUE. Since the second signal line 203 has been changed to TRUE (S710), the driving units 304 of each of the paper feeders 120, 130 and 140 start rotating the motors 303 (S711). As a result, the transport rollers 122, 132 and 142 are driven concurrently.

At step S708, the controller 301 determines whether the first signal line 202 has changed to FALSE. In this case, FALSE means that the trailing edge of the printing paper has passed by the sheet sensor 123. In case of FALSE, control proceeds to step S709, where the controller 301 changes the second signal line 203 to FALSE.

Figure 8A:
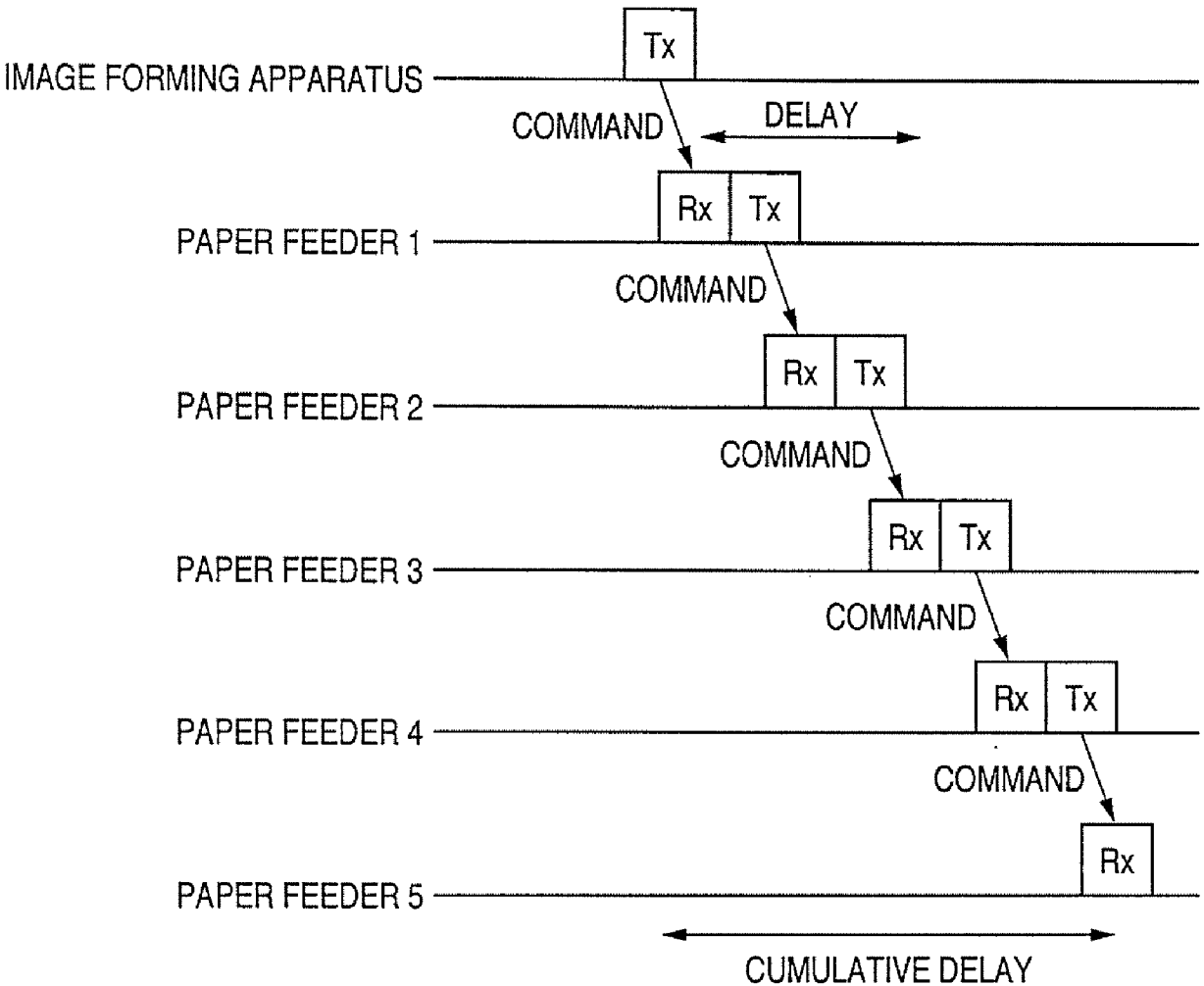
FIGS. 8A and 8B illustrate command traveling timings in a comparative example.
Figure 8B:
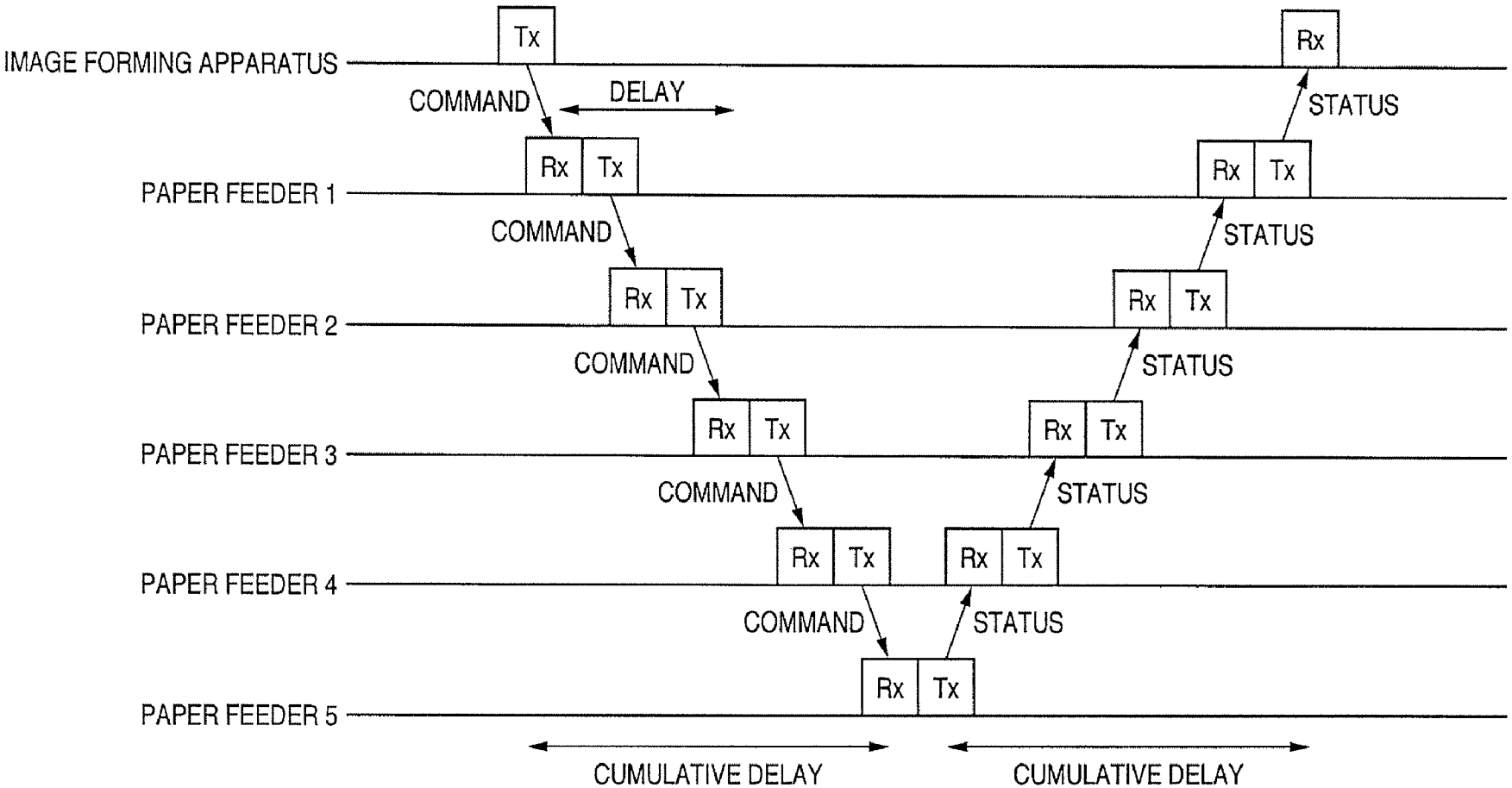

FIGS. 8A and 8B illustrate command traveling timings in a comparative example. In the system of this comparative example, five optional paper feeders have been connected to the image forming apparatus 100 in multiple stages. Further, it is assumed that the image forming apparatus 100 and each of the paper feeders communicate using only the serial communication line 201.

FIG. 8A illustrates a state in which a command instructing a lowermost paper feeder 5 to operate is sent. First, the command is transmitted from the image forming apparatus 100 to an uppermost paper feeder 1, the uppermost paper feeder 1 receives the command and transmits the command to a paper feeder 2 downstream. This receiving and sending of the command is repeated by each paper feeder so that the command indicating start of paper feed arrives at the lowermost paper feeder 5.

More specifically, in case of serial communication, by the time the command transmitted from the image forming apparatus 100 reaches the lowermost paper feeder 5, a delay equivalent to the time it takes to repeat the sending and receiving of the command occurs. In addition, there are also cases where the time needed for the command to travel to each of the paper feeders 1 to 5 also develops a deviation in transmitting and/or receiving timing occurs owing to the status of each paper feeder (e.g., there are instances where a paper feeder is in the course of performing a preparatory operation). Accordingly, in an arrangement in which paper feed and transport are speeded up, it is difficult to stop the printing paper at the pre-feed position P precisely.

Further, the delay is not limited to transmission of a command indicating operation. In a case where the image forming apparatus 100 receives the status of each paper feeder as a status signal, it takes time to receive the status signal as well in the arrangement of the comparative example. FIG. 8B illustrates the sending and receiving of a command and status from transmission of the command, which requests the status of the paper feeder 5, by the image forming apparatus 100 to receipt of the status signal by the image forming apparatus 100. The sending and receiving of the command is repeated by each paper feeder in a manner similar to that of FIG. 8A, and the sending and receiving of the status signal is repeated by each paper feeder. In this arrangement, it takes time for the status signal indicative of the status of the lowermost paper feeder 5 to be received.

In accordance with the present embodiment, however, the output signal from the sheet sensor 123 of the uppermost paper feeder 120 is shared by each of the paper feeders, thereby making it possible for the paper feeders 120, 130 and 140 to halt transport processing concurrently. That is, it is possible to halt the printing paper at the pre-feed position P precisely. Accordingly, the present invention makes it possible to solve problems that occur in related technologies wherein a stop command is transmitted by serial communication in each of the paper feeders. For example, the invention makes it possible to improve upon wrinkling, a decline in image quality and a decline in throughput that occur with printing paper.

Further, it is desirable to provide the second signal line 203 for transmitting to each paper feeder the signal for stopping or starting transport processing in each of the paper feeders concurrently. Furthermore, when the level of the output signal that has been transmitted via the first signal line 202 attains a first level, the controller 301 changes over the level of the signal on the second signal line from a start level for starting transport processing to a stop level for stopping transport processing. As a result, it is possible to stop the printing paper at the pre-feed position P precisely.

Further, in accordance with an instruction from the image forming apparatus 100, the controller 301 may change over the level of the signal on the second signal line 203 from the stop level to the start level. That is, if an instruction representing resumption of drive has been received, transport processing can be resumed concurrently.

Among the controllers 301 included in respective ones of the paper feeders, it is desired that only the controller 301 included in the paper feeder instructed by the image forming apparatus 100 to transport printing paper change over the level of the signal on the second signal line 203. The second signal line 203 is a simple hardware signal line that transmits TRUE or FALSE. Accordingly, owing to the fact that a single controller 301 or switch 302 changes over the signal level of second signal line 203, the image forming system operates stably.

Further, in a case where a paper feeder is itself the uppermost paper feeder, the sheet sensor of this paper feeder is connected to the first signal line 202 by the switch 302. On the other hand, if a paper feeder is not itself the uppermost paper feeder, the sheet sensor of this paper feeder is disconnected from the first signal line by the switch 302. As a result, the output signal from the sheet sensor 123 of the uppermost paper feeder always flows into the first signal line 202. The sheet sensor 123 of the uppermost paper feeder is capable of detecting also the printing paper S that has been fed from any of the paper feeders 120, 130 and 140. Accordingly, it is desired that the sheet sensor 123 of the uppermost paper feeder be connected to the first signal line 202.

It is preferred that even if the order in which the paper feeders 120, 130 and 140 are connected has changed, the sheet sensor of the uppermost paper feeder always be connected to the first signal line 202. For example, the uppermost paper feeder can be discriminated by sensing the member provided on the bonded surface of the image forming apparatus 100 that opposes the uppermost paper feeder 120 (examples of the member being the boss 402, hole 501 and electrically conductive plate 601, etc.). Whether each paper feeder is itself the uppermost paper feeder can be discriminated by the controller 301 based upon information received from the image forming apparatus 100.

The first signal line 202 and second signal line 203 desirably are signal lines that are physically different from the signal line (e.g., serial communication line 201) for receiving instructions from the image forming apparatus 100. Although it is required that the serial communication line 201 be provided from the image forming apparatus 100 to each of the paper feeders, the first signal line 202 and second signal line 203 need only be provided between paper feeders. This can be implemented if the first signal line 202 and second signal line 203 are made signal lines that are physically different from the serial communication line 201.

A case where the first signal line 202 and second signal line 203 are added on from the image forming apparatus 100 to each paper feeder also is conceivable. In this case, it is necessary that the image forming apparatus 100 directly monitor the sheet sensors and control the stopping and driving of the motors 303. In this case, however, a disadvantage is an increased control load on the image forming apparatus 100. Furthermore, the image forming apparatus 100 would require signal lines and connectors and an increase in cost would be unavoidable. In general, a product model that is only the main body of the image forming apparatus that does not include optional feeders is necessary for reasons of marketing strategy. Since such a product model does not require the above-mentioned signals and connectors, it is desired that these not be provided if at all possible. Accordingly, it is desired that the first signal line 202 and second signal line 203 be provided only between paper feeders.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-340920, filed Nov. 25, 2005, which is hereby incorporated by reference herein in its entirety.

What is claimed is:

1. An image forming system that includes an image forming apparatus for forming an image, and a plurality of paper feeders for feeding printing paper, said system comprising:

a communication line by which said image forming apparatus instructs said plurality of paper feeders to perform an operation; and a drive signal line that conveys a driving start signal which makes said paper feeder start driving;

wherein said image forming apparatus transmits a paper-feed start instruction to one of said plurality of paper feeders via said communication line, and said one of said plurality of paper feeders which received the paper-feed start instruction outputs the driving start signal to all of said paper feeders via drive signal line.

2. The image forming system claimed in claim 1, further comprising a sensor signal line for transmitting a detection signal from a printing paper detection sensor of each of said paper feeders to the other paper feeders;

wherein driving of said plurality of paper feeders is stopped in response to the detection signal transmitted via said sensor signal line, whereby transport processing is stopped.

3. The image forming system claimed in claim 2, wherein a detection signal from a printing paper detection sensor of a paper feeder connected directly to said image forming apparatus from among said plurality of paper feeders is transmitted to the other paper feeders via said sensor signal line.

4. The image forming system claimed in claim 2, wherein if the level of the detection signal transmitted via said sensor signal line attains a first level, then the level of a signal on said drive signal line is changed over from a start level for starting transport processing to a stop level for stopping transport processing.

5. The image forming system claimed in claim 1, wherein if each paper feeder has received an operation instruction signal via said communication line, then the level of the signal on said drive signal line is changed over, and said driving unit starts driving of all of said paper feeders in response to change of signal level of said drive signal line.

6. The image forming system claimed in claim 3, wherein each of said paper feeders includes a switch for connecting or disconnecting said printing paper detection sensor to or from said sensor signal line.

7. The image forming system claimed in claim 3, wherein each of said paper feeders includes a detection part for detecting a member provided on a bonded surface of said image forming apparatus.

8. The image forming system claimed in claim 3, wherein each of said paper feeders discriminates, based upon information received from said image forming apparatus, whether it itself is a paper feeder connected directly to said image forming apparatus.

9. The image forming system claimed in claim 1, said communication line is a signal line for performing serial communication.

10. The image forming system claimed in claim 9, wherein said communication line connects the image forming apparatus and all of the paper feeders.

11. The image forming system claimed in claim 1, wherein said drive signal line connects only the paper feeders to one another.

12. A paper feeder connected to an image forming apparatus, comprising:

a communication unit that communicates with said image forming apparatus via a communication line;

a driving signal line that conveys a driving start signal to all paper feeders connected to said image forming apparatus; and a controller that outputs the driving start signal, which makes a driving unit start driving of all paper feeders connected to said image forming apparatus, to said drive signal line in response to a paper-feed start instruction from said image forming apparatus has been received via the communication line by said communication unit.

13. The paper feeder claimed in claim 12, further comprising a printing paper detection sensor that detects printing paper transported to said image forming apparatus; and a sensor signal line for transmitting a detection signal from said printing paper detection sensor to all other paper feeders connected to said image forming apparatus;

wherein if a detection signal has been output from said printing paper detection sensor, then said controller outputs a signal to said sensor signal line and instructs all other paper feeders connected to said image forming apparatus to stop drive, thereby stopping processing for transporting the printing paper.

14. The paper feeder claimed in claim 12, wherein said communication unit is a communication unit for serially communicating with the other paper feeders connected to said image forming apparatus.

15. An image forming system that includes an image forming apparatus for forming an image, and a plurality of paper feeders for feeding printing paper, said system comprising:

a communication line by which said image forming apparatus sending a command to said plurality of paper feeders to perform a feeding operation; and a drive signal line that instructs a driving start to said paper feeders;

wherein said image forming apparatus transmits the command to one of said paper feeders via said communication line, and said one of said plurality of paper feeders which received the command instructs driving start to said paper feeders via drive signal line.

* * * * *